US006200354B1

(12) United States Patent
Collins et al.

(10) Patent No.: US 6,200,354 B1
(45) Date of Patent: Mar. 13, 2001

(54) DYEING OF TEXTILES

(75) Inventors: Geoffrey William Collins, Greasby; Stephen Martin Burkinshaw, Collingham; Roy Gordon, Middlesbrough, all of (GB)

(73) Assignee: Imperial Chemical Industries PLC (GB)

( * ) Notice: Subject to any disclaimer, the term of this patent is extended or adjusted under 35 U.S.C. 154(b) by 0 days.

(21) Appl. No.: 09/379,006

(22) Filed: Aug. 23, 1999

Related U.S. Application Data

(63) Continuation of application No. PCT/GB98/00497, filed on Feb. 18, 1998.

(30) Foreign Application Priority Data

Feb. 24, 1997 (GB) ..... 9703814

(51) Int. Cl.[7] ..... D06P 1/52; D06P 3/60; D06P 5/22

(52) U.S. Cl. ..... 8/554; 8/555; 8/556; 8/606; 8/685; 8/686; 8/918; 8/920; 8/921; 8/930

(58) Field of Search ..... 8/554, 606, 918, 8/555, 556, 685, 686, 920, 921, 930

(56) References Cited

U.S. PATENT DOCUMENTS 4,806,126 * 2/1989 Sternberger et al. .
4,864,007 * 9/1989 Schleusener .
5,024,674 * 6/1991 Prelini et al. .

FOREIGN PATENT DOCUMENTS 44 10 866 10/1995 (DE) .
1 053 672 2/1954 (FR) .
2 146 545 3/1973 (FR) .
1 053 172 12/1966 (GB) .
1 067 102 5/1967 (GB) .

* cited by examiner

*Primary Examiner*—Margaret Einsmann
(74) *Attorney, Agent, or Firm*—Pillsbury, Madison & Sutro, LLP Intellectual Property Grp

(57) ABSTRACT

A method of dyeing cellulosic fibers or fabrics using pre-metallized acid dye by pretreating the fabric with a cationic agent having a plurality of cationic centers and optionally after treating the dyed material with a cationic polymer is disclosed. The cationic polymer is desirably a polyquaternary amine material especially a poly(DADMAC) or polyvinylpyridine. Material dyed by the method has a "washed out" appearance similar to fabrics dyed using the "Jarofast" process, but the availability of a wide range of pre-metallized dyes gives a wider color range, and the method enables a wider range of substrates to be dyed successfully, including lyocell fiber materials e.g. those sold under Courtauld's trademark "Tencel" and blend/union materials with polyamides, easier processing and superior wash and light fastness.

11 Claims, No Drawings

DYEING OF TEXTILES

This is a continuation under 35 U.S.C. Section 120 of International application Ser. No. PCT/GB98/00497 filed on Feb. 18, 1998 which application designates the U.S.

This information relates to the dyeing of textiles, and in particular to the dyeing of pre-treated cellulosic textiles using pre-metallized acid dyes.

It is well known that cellulosic textiles can be dyed with reactive, direct, sulphur, vat and azoic dyes. Other classes of dyestuff, particularly acid dyes, are relatively ineffective in dyeing cellulose substrates because their chemistry does not make them readily substantive to the cellulose fibres.

A recent development in the dyeing of cellulose substrates is a proprietary process known as the Jarofast process, which involves the use of a cationic pretreatment before dyeing with an anionic solubilised sulphur dye, followed by a treatment which removes some of the dye, typically a washing or enzyme treatment step, to produce dyed textile having a "washed out" appearance. This appearance is very fashionable and popular particularly for cotton products such as jeans and related products. The products of this process have a desirable appearance, but the dyeing is not very wash fast and has poor light fastness. Whilst the Jarofast process can be successfully applied to cotton and other similar natural cellulosic fibres, it is less successful in dyeing regenerated cellulosics and does not work at all well on rayon or lyocell materials such as 'Tencel' fabrics made from Courtaulds lyocell fibre.

The present invention is based on our discovery that by using a suitable pretreatment of the cellulosic fibres, pre-metallized acid dyes can be applied to cotton and similar cellulosic substrates, including regenerated cellulosics such as rayon and especially lyocell fibre materials such as 'Tencel' fabrics, to give well dyed products with good wash fastness and which can give dyed fabric with good "washed out" appearance, which can be enhanced by suitable post-dyeing treatment. Further benefits are that in washing in normal use the level of staining of adjacent fabrics is very much lower than is obtained with fabrics treated by the Jarofast process.

Accordingly, the present invention provides a method of making a dyed cellulosic fibrous material, which comprises the steps of:

1 treating the material with a cationic agent having a plurality of cationic centres;

2 dyeing the material with a pre-metallized acid dye; and 3 optionally treating the material with a cationic polymer.

The substrate treated in this invention is described as a fibrous cellulosic textile material. By this we mean that the substrate is cellulosic or contains, typically, from 30 to 100% fibres of, cellulosic material. Typical cellulosic fibre materials which can be included in such fabrics include natural cellulosic fibrous material such as cotton, flax, jute, hemp and ramie, and synthetic or regenerated cellulosic fibrous material such as rayon particularly viscose and acetate rayon and solvent spun materials, particularly where the solvent is N-methylmorpholine oxide (NMMO) which are often referred to as lyocell materials and in particular the lyocell fibre from Courtaulds and the fabrics made from such fibre sold under the Courtaulds trade name 'Tencel'. The cellulosic fibre material can be a blend on more than one type of cellulosic fibre or a blend of fibres of cellulosic fibres with non-cellulosic materials and in particular includes blends of cellulosic fibres, particularly cotton, rayon and especially lyocell, fibre with polyester, particularly polyethylene terephthalate polymer or related copolymer, fibre, or with polyamide fibres, including wool, silk and synthetic polyamides such as nylon. The textile can be a woven (including knitted) or non-woven textile, but will usually be a clothing textile material.

The polymeric pretreatment agent used in the invention is cationic and such materials are referred to as cationic polymeric pretreatment agents. The cationic polymeric pretreatment agents are polymer including a plurality of cationic centres and are usually made by polymerisation of monomers containing cationic or potentially cationic centres. Desirably the cationic centres are quaternary nitrogen centres which may be aliphatic quaternary ammonium groups or quaternary aromatic nitrogen centres. The quaternary nitrogen centre may be present as such in the polymeric agent or may be present under application conditions or may be generated in situ after application to the textile. Examples of cationic quaternary nitrogen centres which can be present in the polymeric pretreatment agent include: $—N^+(R)_3$ where each R is an alkyl group particularly a $C_1$ to $C_4$ alkyl e.g. methyl group, although one or more of the R groups may be a longer chain alkyl group e.g. a $C_6$ to $C_{18}$ alkyl group, or where two of the groups R together with the nitrogen atom bearing them form a heterocyclic ring, particularly a 5 or 6 membered ring, which may include further hetero atoms, such as piperidine, tetrahydropyrrole, piperazine and morpholine rings, which may themselves be further substituted as in N-alkyl e.g. methyl, piperazine rings; or one of the R groups may be a group, typically an alkylene group, linking to another, usually nitrogen, site in the polymer or to another polymer chain; or $—N^+(R')_2—$ where the groups R' are as defined for R above and the other bonds directly or indirectly link into the polymer chain optionally via a ring, usually a 5- or 6-membered ring; and aromatic quaternary nitrogen centres such as pyridinium.

The degree of cationicity (expressed as cationic centres per units of molecular weight) is generally at least 1 cationic, particularly quaternary nitrogen centre, per 1500 Daltons (D), desirably at least 1 cationic centre per 1000 D, more usually at least 1 cationic centre per 750 D and with the most effective polymers we have tested at least 1 cationic centre per 500 D. The maximum concentration of cationic centres is about 1 per 120 D, desirably not more than about 1 per 150D. (Relative molecular weights are expressed including chloride as a counter ion for cationic centres.)

Expressed as cationic centres per monomer residue in the polymer, the polymer typically has at least about 1 cationic centre per 20, more usually at least about 1 cationic centre per 10, and desirably at least about 1 cationic centre per 5, monomer residues in the polymer. The upper limit is typically 1 cationic centre per monomer residue.

Examples of cationic polymeric pretreatment agents include polymers of diallyldimethylammonium chloride (which polymerises to give a repeat unit including cyclic, 5- and/or 6membered ring including dimethyl ammonium groups)—conveniently referred to under the abbreviation poly-DADMAC (diallyldimethylammonium chloride) such as is available under the trade name Matexil FC-ER from ICI Surfactants, quaternised (co-)polymers of vinylpyridines, such as 4-vinylpyridine, copolymers of dimethylamine and epi-chlorohydrin such as is available under the trade name Fixogene CXF from ICI Surfactants and copolymers of diallyldimethylammonium and diallyl-N-2-hydroxy-3chloro-propylamine (or its protonated ammonium derivative) and copolymers having repeat units of diallylmethylamine (or its protonated ammonium derivative) and diallyl-N-methyl-N-2-hydroxyl3-chloropropylammonium.

The charge balancing anions for the quaternary ammonium groups are typically halide, particularly chloride, ions. These latter two copolymers are capable of crosslinking or similar reactions involving the chloride substituent on the propyl group and other nitrogen centres.

The cationic polymeric pretreatment agents used in this invention typically have molecular weights of from 5 to 50 kD and more desirably from 10 to 30 kD.

The use of cationic polymeric pretreatment agents has the advantage that they are strongly substantive to the cellulosic fibres, and are thus readily applied to the textiles, and typical pre-metallized acid dyes are substantive to the treated cellulosic textile material. This can substantially ease application of the dyes to the cellulosic textile material for example reducing or eliminating the need for the use of salts to encourage substantivity and making it possible to operate to high dye solution exhaustion.

The cationic polymeric pretreatment agents used in this invention typically have molecular weights of from 5 to 50 kD and more desirably from 10 to 30 kD.

The pre-treatment of the fabric with the polymeric pretreatment agent can be carried out by immersing the fabric in an aqueous solution or dispersion of the pretreatment agent at temperatures of up to about 100° C., particularly from about 20 to about 80° C., for a period of up to 2 hours, particularly from 15 minutes to 1 hour, e.g. from 20 to 30 minutes. Temperatures of about 40° C. are particularly appropriate for cotton and similar natural cellulosic materials although higher temperatures may be used. Temperatures of about 60 to about 80° C. are particularly appropriate for synthetic cellulosic materials such as rayon and especially lyocell materials, because the polymer is generally more crystalline than natural cellulosics, although again higher temperatures may be used.

The amount of the pretreatment agent in the treatment bath is desirably from 0.1 to 3%, particularly 0.25 to 2% and especially from 0.5 to 1%, by weight of 100% active pretreatment agent based on the dry weight of the fabric being pretreated. (Note—the pretreatment agents are typically supplied as 30 to 35% active aqueous solutions and this will be taken into account in determining the amount of the particular product used.) The liquor ratio (the ratio of the treatement/dye solution used to dry cloth weight) for pretreatment is typically from 5 to 25 desirably about 10. The pre-treatment solution is typically at or near neutral e.g. pH 6 to 7, but may be higher e.g. up to abut 11 and in particular 8 to 11, where rayon or lyocell materials are being treated.

The pretreatment can also be carried out by padding at ambient temperature using concentrations and pH values similar to those described above to give pick up typically about 70 to 150% by weight based on the dry fibre weight with padding, followed by drying typically at from about 80 to about 150° C., more usually from about 80 to about 120° C.

The pre-metallized acid dyes used in this invention are acid dyes including a chelated metal, which is usually a multivalent transition metal such as chromium, cobalt, copper, zinc and iron, but usually chromium. The metal is typically chelated to oxygen atoms derived from phenolic groups in the organic acid dye molecule and usually also to azo nitrogen atoms via dative bonds. The pre-metallized acid dye molecules may carry an overall electrical charge depending on the valency (oxidation state) of the metal and the number and type of chelating sites in the organic acid dye. Pre-metallized acid dyes fall into four general categories:

1 1:1 pre-metallized acid dyes—in which each pre-metallized acid dye molecule includes one chelated metal centre and one organic acid dye molecule, typically including at least one sulphonic acid group, which may be neutralised with a suitable cation such as an alkali metal cation e.g. sodium. Usually, the acid dye molecule will have insufficient chelating centres to fully occupy the available chelating power of the metal and the remaining ligands are provided by the water solvent. An Example is Colour Index (Cl) Acid Brown 144:

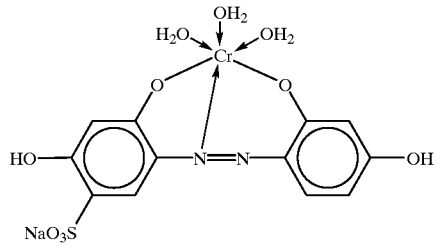

2 2:1 pre-metallized acid non-ionic solubilised dyes—in which each pre-metallized acid dye molecule includes one chelated metal centre and two organic dye molecules, usually the same, which in the pre-metallized acid dye carries no free acid substituents. The dye molecules are the only ligands for the chelated metal. In order to ensure that the pre-metallized acid dye is sufficiently water soluble, the organic dye part of the molecule will include hydrophilic substituents such as sulphonamido groups. An Example is Colour Index (Cl) Acid Black 60:

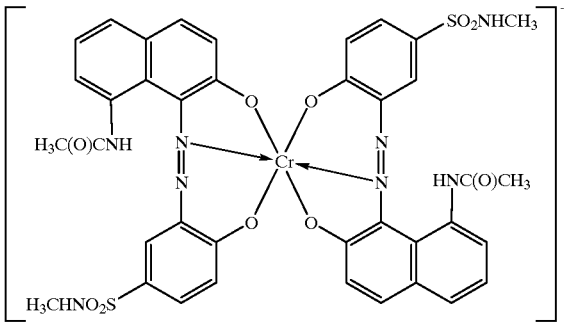

3 2:1 pre-metallized acid asymmetrical monosulphonated dyes—in which each pre-metallized acid dye molecule includes one chelated metal centre and two, different organic dye molecules. One of the dye molecules includes a sulphonic acid group and the other usually is non acidic. Examples include Neutrichrome S dyes such as:

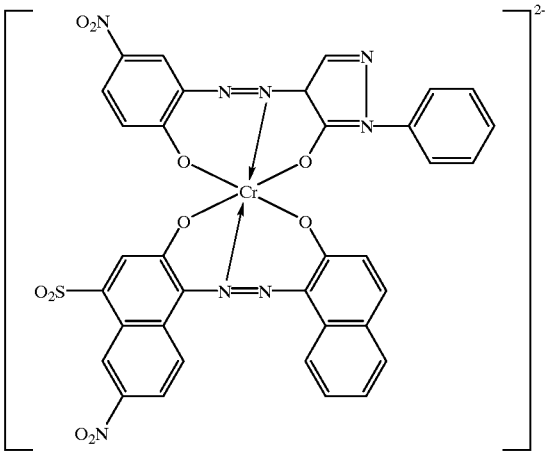

4 2:1 pre-metallized acid symmetrical di-sulphonated/dicarboxylated dyes—in which each pre-metallized add dye molecule includes one chelated metal centre and two, identical organic dye molecules. Each of the dye molecules includes a sulphonic and/or carboxylic acid group Examples include Acidol M dyes such as:

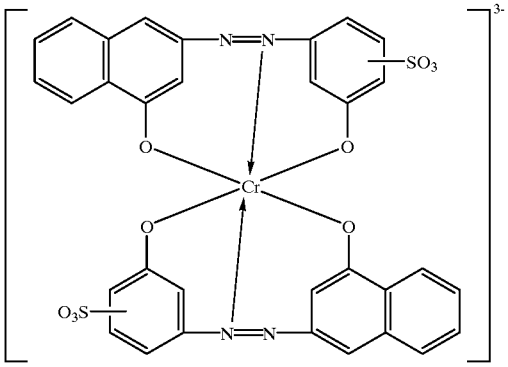

Although each of these types of pre-metallized acid dyes can be used in this invention, we have obtained particularly good results with 2:1 pre-metallized acid asymmetrical monosulphonated dyes and the use of these dyes forms a specific and advantageous aspect of the invention. Suitable specific dyestuffs include those of the Lanasyn S (Sandoz now Clairant) range including Lanasyn Olive Green S4GL (Cl Acid Green 106), Lanasyn Yellow S-2GL (Cl Acid Yellow 235) and Lanasyn Navy S-BL (Cl Acid Blue 296), the Lanacron S (Ciba) range including Lanacron Red SG (Cl Acid Red 315), and Lanacron Grey SB (Cl Acid Black 207) and the Neutrilan S range (Compton & Knowles) such as Neutrilan Rubine S-2R, Neutrilan Orange SR and Neutrilan Navy S-B.

The conditions of dyeing will depend on the specific nature of the pre-metallized acid dye although in general we have successfully used typical conditions for the dyeing of wool with pre-metallized acid dyes. Typically these conditions are dyeing at the boil i.e. at or near 100° C., at mildly acid pH typically in the range 5 to 7, at a concentration corresponding to 0.1 to 5% of dye based on the weight of the dry fibre at a liquor ratio of from 2 to 25 more commonly about 10. In any particular case, the amount of dye used, and possibly the concentration of dye in the dyebath and thus the amount applied to the textile, will depend on the dye itself and the desired intensity of dyeing.

After dyeing it is desirable to remove any unbound pre-metallized acid dye from the cellulosic textile material. This has not proved difficult and simple washing in water has proved effective, particularly as the pre-metallized acid dyes exhaust readily onto the pre-treated cellulosic textile material.

After dyeing the cellulosic textile material can be further treated with a cationic polymer. The cationic polymer used for such a post treatment will generally be of the same type as the cationic polymeric pretreatment agents as described above, referred to in this context as cationic polymeric post-treatment agents. Similarly, the treatment conditions, concentrations and amounts are within the general and specific ranges set out above for the cationic polymeric pretreatment agents. The cationic polymeric post-treatment agents are substantive to the cellulosic textile material and we believe that they form a coating or layer over the dye on the cellulosic textile material and this can further improve the wash fastness of the dyeing and may reduce any tendency of the pre-metallized acid dye to migrate in washing onto other co-washed materials. The treatment with cationic polymeric post-treatment agents will typically be carried out after post-dyeing washing. If a cationic polymeric post-treatment agent including a group reactive to other parts of the cationic polymeric post-treatment agents or to the cationic polymeric pretreatment agent or the cationic nucleophilic polymeric pretreatment agent is used, it is possible to generate higher molecular weight species by linking, crosslinking and polymerisation. This may further enhance the wash fastness of the dyed fabric. An example of such reactive cationic polymeric post-treatment agents are copolymers having repeat units of diallylmethylamine (or its protonated ammonium derivative) and diallyl-2-hydroxy3chloropropyl amine (or its protonated ammonium derivative) or repeat units of diallylmethylamine (or its protonated ammonium derivative) and diallyl-N-methyl-N-2-hydroxyl-3-chloropropylammonium. These latter two copoplymers may undergo crosslinking and similar reactions involving the chloride substituent on the propyl group and other nitrogen centres.

The dyed fabrics can, if desired, be subjected to further deliberate washing or enzyme treatment to enhance the 'washed out' appearance.

Using the pretreatment step according to the invention, we have successfully obtained good dyed products having good wash and light fastness and good i.e. little, staining of adjacent fabrics in washing. The results are generally at least as good as those obtained using the Jarofast system. The optional post dyeing treatment with cationic polymeric post-treatment agents can further improve the wash and reduce staining of adjacent fabrics in washing. The ability to use pre-metallized acid dyes to give good wash fastness (even if in the context of producing "faded" coloured products) has the benefit that the light fastness of the dyes is much better than is typically obtained using the sulphur dyes used in the Jarofast process.

The substrates that can be dyed include not just cotton (as in the Jarofast system) but other cellulosic textile materials, including rayons and lyocell materials including 'Tencel' fabrics, that have proved difficult to dye satisfactorily previously.

The increased substantivity of pre-metallized acid dyes to cellulosic textile materials obtained in the present invention, makes it possible to dye mixed or blended fabrics with pre-metallized acid dyes. In particular, the pretreatment enables union fabrics of cellulosic fibres, particularly cotton, rayons and lyocell materials, with polyamide fibres such as wool, silk and nylon, to be dyed relatively easily and uniformly. This possibility forms a specific aspect of the invention which accordingly includes a method of dyeing a blend or union fabric containing cellulosic fibres, particularly of cotton rayon or, and especially, lyocell, and polyamide fibres particularly of wool, silk or nylon, which includes the steps of:

1 treating the material with a polymeric pretreatment agent having a plurality of cationic centres;

2 dyeing the material with a pre-metallized acid dye; and 3 optionally treating the material with a cationic polymer.

A further advantage of this invention is that many of the environmental difficulties associated with conventional cellulosic dyeing processes can be mitigated or avoided. For example, conventional cellulose reactive dyeing processes generate large amounts of highly coloured effluents containing high concentrations of electrolyte (up to 100 $g.l^{-1}$) and alkali. The present process does not generate such effluents, because salts, such as NaCl, are not needed to drive exhaustion of the dye onto the substrate, the pre-metallized acid dyes are substantive to the pre-treated cellulosic textile materials and readily dye to high levels of exhaustion without adding salts, with some pre-metallized acid dyes we have achieved 100% exhaustion of the dye bath. Where the pre-metallized acid dyes do not exhaust fully, it is possible to recycle the dyebath content as the bath contains only dye and water at the start and end of the dyeing cycle. The dyeing process is itself simple, requiring no costly and time consuming wash off procedures.

The following Examples illustrate the invention, all parts and percentages are by weight unless otherwise stated.

| Materials<br>Dyes | |
|---|---|
| Lanasyn S dyes | ex Sandoz/Clairant |
| Lanasyn Olive Green S-4GL | CI Acid Green 106 |
| Lanasyn Yellow S-2GL | CI Acid Yellow 235 |
| Lanasyn Navy S-BL | CI Acid Blue 296 |
| Lanacron | ex Ciba |
| Lanacron Red SG | (CI Acid Red 315) |
| Lanacron Grey SB | (CI Acid Black 207) |
| Neutrilan S dyes | ex Compton and Knowles |
| Neutrilan Rubine S-2R | |
| Neutrilan Navy S-B | |

| Cationic polymeric pretreatment agents | | |
|---|---|---|
| PT1 | Matexil FC-ER | a poly(DADMAC) cationic polymer ex ICI Surfactants |
| PT2 | Fixogene CXF | a copolymer of dimethylamine and epi-chlorohydrin ex ICI Surfactants |
| PT3 | a copolymer of diallyldimethylammonium and diallyl-2-hydroxy-3-chloropropylammonium | |
| **Cationic polymeric post-dyeing treatment agents** | | |
| AT1 | Matexil FC-ER | poly(DADMAC) cationic polymer solution (35% active solids) ex ICI Surfactants |
| AT2 | Fixogene CXF | cationic polymer (reaction product of dimethylamine and epi-chlorohydrin) solution (50% active solids) ex ICI Surfactants |
| AT3 | a copolymer of diallyldimethylammonium and diallyl-2-hydroxy-3-chloropropylammonium | |

In the pre- and post-treatment polymers the counter-anion was chloride.

Pretreatment

On cotton the pretreatment was carried out by immersing samples of scoured, bleached, FBA free woven cotton (150 $g.m^{-2}$) in an aqueous solution of the pretreatment agent at 2% (of pretreatment agent as supplied) on the dry fabric weight at a liquor ratio L:R of 10:1, at 40 to 50° C. for 30 minutes at pH 6 to 7.

On lyocell fabric ('Tencel' fabric made from Courtaulds lyocell fibre) the pretreatment was carried out by immersing samples of the fabric (190 $g.m^{-2}$) in an aqueous solution of the pretreatment agent at 2% (of pretreatment agent as supplied) on the dry fabric weight, and further containing 1 $g.l^{-1}$ $Na_2CO_3$, at a liquor ratio L:R of 10:1, at 60° C. for 30 minutes. The higher temperature and alkali were used to aid penetration of the inherently more closely packed structure of the lyocell fibre.

On the blends with other, particularly polyamide fibres, the pretreatment was carried out by immersing samples of the fabrics in an aqueous solution of the pretreatment agent at 2% (of pretreatment agent as supplied) on the dry fabric weight at a liquor ratio L:R of 10:1, at 50° C. for 30 minutes at a pH of about 7.

Dyeing

The pretreated fabric was wetted out and immersed in the dyebath which contained only dye and water at pH 6 to 7 to give a L:R of 10:1. Dyeing was commenced at room temperature and the temperature was raised to 95 to 98° C. and held at this temperature for 60 minutes. The dyed fabric was rinsed with cold running water until clear, to remove loosely held surface dye, then allowed to dry. For comparison, dyeings were also carried out on blank (non-pretreated) samples.

Post-dyeing Treatment (Aftertreatment)

When carried out, aftertreatment on all fabrics was carried out by immersing the dyed samples in an aqueous solution of the aftertreatment agent (as supplied) at 2% (of aftertreatment agent as supplied) on the dry fabric weight at a liquor ratio L:R of i 10:1, at 40 to 50° C. for 30 minutes. For aftertreatment agents AT1, and AT2 the pH used was 6 to 7; for aftertreatment agent AT3 the pH used was 10 to 11 (adjusted with about 2 ml (30% aqueous NaOH solution).$l^{-1}$(aftertreatment bath). The samples were subsequently rinsed in cold water and dried.

Test Methods

Wash Fastness

Wash fastness was assessed using the ISO C06/A2S: Colour fastness to domestic and commercial laundering (40° C.) test. The test was carried out on samples (10 cm×4 cm) of the dyed substrate under test, stapled to a 4 cm wide piece of standard SDC Multifibre DW adjacent (including secondary acetate, cotton, nylon, polyester, acrylic, wool). Assessment of the change in shade and staining of adjacents was made with the appropriate 9 point grey scales (high scores good).

Colour Measurement

Dyed samples were measured instrumentally. The colorimetric variables L*, a* and b* were measured and colour strength (K/S) was calculated by computer from the reflectance at the wavelength of maximum absorption using the formula:

$$K/S=(1-R)^2/2R \text{ where R is \% reflectance.}$$

Light Fastness

Light fastness data was measured by a standard accelerated fading test, ISO B02: Colour fastness to artificial light: Xenon arc fading lamp test Alkaline Perspiration Fastness Alkaline perspiration fastness was measured by the ISO E04 alkaline perspiration fastness test.

EXAMPLE 1

This Example illustrates the dyeing of Cl Acid Green 106 on cotton samples. The details of the pre- and after-treatments, Wash Fastness and colorimetric data are included in Table 1 below. These data show that pretreatment increases the colour intensity (because the uptake of the dye is greatly improved), improves wash fastness and reduces adjacent staining of the dyeings. The more intense colour obtained from pretreatment with PT2 probably arises from the higher solids of the treatment agent as supplied by the manufacturer. Aftertreatment does not have a negative effect on colour strength or shade change, confirming the visual assessment made during the experiment. The wash fastness testing shows that some colour loss occurs during washing but with virtually no adjacent staining. In all cases aftertreatment reduced the amount of colour loss suffered during washing.

EXAMPLE 2

This Example illustrates the dyeing of Cl Acid Red 315, Cl Acid Yellow 235, Cl Acid Black 207 and Cl Acid Blue 296 on cotton samples. The details of the pre- and after-treatments and wash fastness and colorimetric data are set out in Table 2 below. From these data it is clear that the pretreatment is very effective in enhancing substantivity of the dye on the fabric without the use of salts in the dyebath. In the tests using Cl Acid Yellow 235 and Cl Acid Black 207 the dye baths were almost completely exhausted (even though no steps had been taken to optimise the system to seek full exhaustion). The application of an aftertreatment resulted in very little if any colour loss from the samples, the results were comparable to those in Example 1 for Cl Acid Green 106, and had no effect on the shade. Wash fastness testing gave results broadly similar to those of Example 1 Cl Acid Green 106; the aftertreatment reduced the colour loss from the samples and also reduced the staining of adjacent multifibre samples.

TABLE 1

| | Pre-treatment | | After-treatment | | shade | adjacent | Colorimetric data | | | |
|---|---|---|---|---|---|---|---|---|---|---|
| Sample | matl | % | matl | % | change | staining | L* | a* | b* | K/S |
| 1C | — | — | — | — | * | * | 68.55 | −9.81 | 11.48 | 0.9 |
| 1.1 | PT1 | 2 | — | — | 3–3/4 | 4/5–5 | 43.17 | −11.72 | 14.72 | 5.60 |
| 1.2 | PT1 | 2 | AT1 | 2 | 3/4–4 | 5 | 42.71 | −11.47 | 14.57 | 5.78 |
| 1.3 | PT1 | 2 | AT2 | 2 | 3/4 | 5 | 42.24 | −11.53 | 14.43 | 5.80 |
| 1.4 | PT1 | 2 | AT3 | 2 | 4–4/5 | 5 | 42.59 | −11.37 | 14.36 | 5.73 |
| 1.5 | PT2 | 2 | — | — | 2–2/3 | 4/5–5 | 42.00 | −11.30 | 14.38 | 6.05 |
| 1.6 | PT2 | 2 | AT1 | 2 | 3/4 | 5 | 41.84 | −11.01 | 14.06 | 6.01 |
| 1.7 | PT2 | 2 | AT2 | 2 | 2/3–3 | 5 | 41.55 | −11.07 | 13.99 | 6.06 |
| 1.8 | PT2 | 2 | AT3 | 2 | 4/5 | 5 | 41.84 | −11.32 | 14.18 | 5.97 |

*the dyeing on the untreated cloth was too weak to generate meaningful wash fastness data.

TABLE 2

| | Pre-treatment | | After-treatment | | shade | adjacent staining | | | colorimetric data | | | |
|---|---|---|---|---|---|---|---|---|---|---|---|---|
| Sample | matl | % | matl | % | change | cotton | nylon | wool | L* | a* | b* | K/S |
| | | | | | | Cl Acid Red 315 | | | | | | |
| 2C.1 | — | — | | | | | | | 59.72 | 32.57 | 10.00 | 1.96 |
| 2.1.1 | PT1 | 2 | — | — | 3 | 2/3 | 3-3/4 | 4 | 36.38 | 32.73 | 13.74 | 9.89 |
| 2.1.2 | PT1 | 2 | AT1 | 2 | 3/4 | 3 | 3/4-4 | 4/5 | | | | |
| 2.1.3 | PT1 | 2 | AT3 | 2 | 4 | 3-3/4 | 4 | 4/5 | | | | |
| 2.1.4 | PT2 | 2 | — | — | 2/3 | 2/3 | 3-3/4 | 3/4-4 | 35.34 | 33.60 | 14.47 | 10.93 |
| 2.1.5 | PT2 | 2 | AT1 | 2 | 3/4 | 3 | 3/4 | 4 | | | | |
| 2.1.6 | PT2 | 2 | AT3 | 2 | 4 | 3/4 | 4 | 4/5 | | | | |
| | | | | | | Cl Acid Yellow 235 | | | | | | |
| 2C.2 | — | — | | | | | | | 76.09 | 10.10 | 46.03 | 2.17 |
| 2.2.1 | PT1 | 2 | — | — | 3 | 4/5 | 3/4 | 4-4/5 | 63.65 | 17.87 | 54.92 | 7.23 |
| 2.2.2 | PT1 | 2 | AT1 | 2 | 3/4 | 4/5 | 4-4/5 | 4/5 | | | | |
| 2.2.3 | PT1 | 2 | AT3 | 2 | 3/4-4 | 5 | 4/5 | 4/5 | | | | |
| 2.2.4 | PT2 | 2 | — | — | 2-2/3 | 4/5 | 3-3/4 | 4 | 65.40 | 17.96 | 55.46 | 6.54 |
| 2.2.5 | PT2 | 2 | AT1 | 2 | 3/4-4 | 4/5 | 4 | 4/5 | | | | |
| 2.2.6 | PT2 | 2 | AT3 | 2 | 4 | 5 | 4/5 | 4/5 | | | | |

TABLE 2-continued

| Sample | Pre-treatment matl | Pre-treatment % | After-treatment matl | After-treatment % | shade change | adjacent staining cotton | adjacent staining nylon | adjacent staining wool | colorimetric data L* | a* | b* | K/S |
|---|---|---|---|---|---|---|---|---|---|---|---|---|
| | | | | | Cl Acid Black 207 | | | | | | | |
| 2C.3 | — | — | | | | | | | 51.78 | −1.80 | 4.42 | 1.85 |
| 2.3.1 | PT1 | 2 | — | — | 3/4 | 4-4/5 | 3/4 | 5 | 29.10 | −1.26 | −2.59 | 8.55 |
| 2.3.2 | PT1 | 2 | AT1 | 2 | 4 | 4/5 | 4 | 5 | | | | |
| 2.3.3 | PT1 | 2 | AT3 | 2 | 4 | 4/5 | 4/5 | 5 | | | | |
| 2.3.4 | PT2 | 2 | — | — | 3/4 | 4 | 3-3/4 | 5 | 27.93 | −0.38 | −1.79 | 9.09 |
| 2.3.5 | PT2 | 2 | AT1 | 2 | 4 | 4/5 | 4 | 5 | | | | |
| 2.3.6 | PT2 | 2 | AT3 | 2 | 4 | 4/5 | 4/5 | 5 | | | | |
| | | | | | Cl Acid Blue 296 | | | | | | | |
| 2.C.4 | — | — | | | | | | | 60.79 | −1.17 | −9.54 | 1.06 |
| 2.4.1 | PT1 | 2 | — | — | 3/4 | 4-4/5 | 3/4 | 5 | 26.74 | 0.24 | −11.30 | 11.34 |
| 2.4.2 | PT1 | 2 | AT1 | 2 | 4 | 4/5 | 4 | 5 | | | | |
| 2.4.3 | PT1 | 2 | AT3 | 2 | 4 | 4/5 | 4/5 | 5 | | | | |
| 2.4.4 | PT2 | 2 | — | — | 3/4 | 4 | 3-3/4 | 5 | 25.14 | 0.51 | −10.58 | 12.53 |
| 2.4.5 | PT2 | 2 | AT1 | 2 | 4 | 4/5 | 4 | 5 | | | | |
| 2.4.6 | PT2 | 2 | AT3 | 2 | 4 | 4/5 | 4/5 | 5 | | | | |

EXAMPLE 3

Samples of dyed fabrics produced in Examples 1 and 2 were tested for Light Fastness and Alkaline Perspiration Fastness and the results are set out in Table 3 below. These data show that the process of the invention provides dyeings with good Light Fastness and good Alkali Perspiration Fastness. Similar trends to wash fastness can be seen in that with Cl Acid Red 315 the overall fastness is slightly lower.

TABLE 3

| Sample | Dye | Light Fastness rating | Akaline Perspiration Fastness shade change | adjacent staining cotton | adjacent staining nylon | adjacent staining wool |
|---|---|---|---|---|---|---|
| 1.1 | CI Acid Green 106 | 6–7 | — | — | — | — |
| 2.1.1 | CI Acid Red 315 | 5 | 4/5 | 3/4 | 4 | 4 |
| 2.2.1 | CI Acid Yellow 235 | 6–7 | 5 | 4–4/5 | 4–4/5 | 5 |
| 2.3.1 | CI Acid Black 207 | 6–7 | 5 | 4/5 | 4/5 | 5 |
| 2.4.1 | CI Acid Blue 296 | 6–7 | 5 | 4/5 | 4/5 | 5 |

EXAMPLE 4

This Example illustrates the dyeing of lyocell fibre 'Tencel' fabric with pre-metallized acid dyes. The fabric was pretreated with agent PT1 and aftertreatment as set out in Table 4 below. Fastness and colorimetric data are included in Table 4. These data show that the lyocell fibre was successfully dyed by the method of this invention and dyeings of comparable colour strengths to those on cotton were achieved. The general trends in wash fastness are also similar to those on cotton, with the fastness on 'Tencel' being slightly higher all round than on cotton. We believe that this is because the molecules in the lyocell fibres are more closely packed than those in cotton. Correspondingly we believe this is why lyocell fibre material is more difficult to dye and may explain why the Jarofast system is ineffective. (The large non-reduced molecules of the solubilised sulphur dyes used in the Jarofast system cannot penetrate into the fibre, so they remain on the surface and are subsequently easily removed during washing.) The improved wash fastness is even more pronounced following aftertreatment; we believe that the pre-metallized acid dye is further insolubilised by complexation with the cationic sites in the cationic polymeric post-treatment agent. The Light Fastness ratings of the dyes on the lyocell fibre material are generally slightly higher than their counterparts on cotton.

TABLE 4

| Sample | Pre-treatment matl | Pre-treatment % | After-treatment matl | After-treatment % | Wash Fastness shade change | adjacent staining cotton | adjacent staining nylon | Light Fastness | colorimetric data L* | a* | b* | K/S |
|---|---|---|---|---|---|---|---|---|---|---|---|---|
| | | | | | Cl Acid Green 106 | | | | | | | |
| 5.1.1 | PT1 | 2 | — | — | 4/5 | 4/5-5 | 5 | | | | | |
| 5.1.2 | PT1 | 2 | AT1 | 2 | 5 | 5 | 5 | 7 | 43.78 | −14.16 | 17.59 | 6.28 |
| 5.1.3 | PT1 | 2 | AT3 | 2 | 5 | 5 | 5 | | | | | |

TABLE 4-continued

| | Pre-treatment | | After-treatment | | Wash Fastness shade change | adjacent staining cotton | adjacent staining nylon | Light Fast-ness | colorimetric data L* | a* | b* | K/S |
|---|---|---|---|---|---|---|---|---|---|---|---|---|
| Sample | matl | % | matl | % | | | | | | | | |
| | | | | | Cl Acid Red 315 | | | | | | | |
| 5.2.1 | PT1 | 2 | — | — | 3/4 | 2/3 | 3-3/4 | | | | | |
| 5.2.2 | PT1 | 2 | AT1 | 2 | 4 | 3 | 3/4 | 5/6 | 39.65 | 37.21 | 13.5 | 8.93 |
| 5.2.3 | PT1 | 2 | AT3 | 2 | 4 | 3/4 | 4 | | | | | |
| | | | | | Cl Acid Yellow 235 | | | | | | | |
| 5.3.1 | PT1 | 2 | — | — | 3/4-4 | 4-4/5 | 3/4-4 | | | | | |
| 5.3.2 | PT1 | 2 | AT1 | 2 | 4/5 | 5 | 4-4/5 | 7 | 63.73 | 16.42 | 57.22 | 8.25 |
| 5.3.3 | PT1 | 2 | AT3 | 2 | 4/5 | 5 | 4/5 | | | | | |
| | | | | | Cl Acid Black 207 | | | | | | | |
| 5.4.1 | PT1 | 2 | — | — | 3/4 | 4-4/5 | 3/4 | | | | | |
| 5.4.2 | PT1 | 2 | AT1 | 2 | 4 | 4/5 | 4 | 7 | 31.91 | −2.18 | −3.27 | 7.15 |
| 5.4.3 | PT1 | 2 | AT3 | 2 | 4 | 4/5 | 4-4/5 | | | | | |
| | | | | | Cl Acid Blue 296 | | | | | | | |
| 5.5.1 | PT1 | 2 | — | — | 4/5 | 4/5 | 3/4 | | | | | |
| 5.5.2 | PT1 | 2 | AT1 | 2 | 4/5 | 4/5 | 4 | 7 | 28.38 | −1.02 | −14.74 | 11.22 |
| 5.5.3 | PT1 | 2 | AT3 | 2 | 4/5 | 5 | 4/5 | | | | | |

EXAMPLE 5

This Example illustrates the dyeing of viscose/wool and lyocell/wool union fabrics with pre-metallized acid dyes. Samples of 50:50 lyocell/wool and wool/viscose intimate fibre blend fabrics were pretreated and dyed with Cl Acid Black 207 as described above. Information on the pretreatment and Wash Fastness and colorimetric data are given in Table 5 below.

TABLE 5

| | Pre-treatment | | shade | adjacent staining cot- | adjacent staining | colorimetric data | | | |
|---|---|---|---|---|---|---|---|---|---|
| Sample | matl | % | change | ton | nylon | L* | a* | b* | K/S |
| lyocell/wool | | | | | | | | | |
| 7C.1 | — | — | 4/5–5 | 4/5–5 | 4–4/5 | 30.42 | 0.05 | −2.66 | 7.24 |
| 7.1 L/W | PT1 | 2 | 4/5 | 4/5 | 3/4–4 | 24.23 | −0.75 | −2.9 | 12.21 |
| viscose/wool | | | | | | | | | |
| 7C.2 | | — | 4/5 | 4/5–5 | 4/5 | 38.13 | −0.19 | -2.17 | 4.16 |
| 7.2 V/W | PT1 | 2 | 4/5 | 4/5 | 3/4–4 | 5.32 | −1.3 | −3.48 | 11.58 |

These data clearly showed the effect of the pretreatment:

In the samples which were not pretreated, the wool portion dyed successfully, whilst the lyocell or viscose only stained—the resultant dyeings were clearly mottled. In the samples that had been pretreated the colour was far more uniform and had a deeper shade.

The dye baths for all these samples were 100% exhausted (with or without pretreatment) showing how efficient the dyes are for colouring wool. The Wash Fastness ratings of the dyeings were very similar to those of the cotton and 'Tencel' fabric dyeings in previous Examples. The appearance of reduced numerical Fastness ratings for the pretreated samples arises from the much greater colour depth achieved on the cellulosic portion of the blend in these samples. (It is well known that pre-metallized acid dyes possess high fastness on wool, as can be seen from the data on the non-pretreated sample fastness data in Table 6, in which only the wool portion was dyed.)

EXAMPLE 6

The dyeings of Example 5 on fibre blend fabrics were extended to other fabrics and other dyes. Fibre blend fabrics were made up with the following materials: velour (nylon/cotton), cotton/silk, linen/silk and hemp/cotton/wool (this fabric was made using a relatively crude blend of the different fibres). The fabrics were pretreated with PT1 at described above and samples were then dyed with Neutrilan Rubine S-2R and Neutrilan Navy S-B respectively. The dyeing conditions were that the temperature was raised to 98° C. at a rate of 2° C. $min^{-1}$ and held at 98° C. for 60 minutes. The dyed fabrics were briefly washed, rinsed and dried. The pretreated fabrics dyed to give uniform dyeings of a deeper shade than non-pretreated controls. For the first three mixed fibre fabrics, the fibre blends were intimate enough that the control dyeings looked uniform, but the dyeings on the pretreated fabrics were of a much deeper shade. For the hemp/cotton/wool mixed fabric, the control dyeing looked mottled, whereas the dyeings on the pretreated fabric were uniform and of a much deeper shade. Wash Fastness testing gave similar results to those on viscose/wool and lyocell/wool mixtures described in Example 5. After treatment with AT1 further improved the Wash Fastness of these samples.

What is claimed is:

1. A method of making a dyed cellulosic fibrous material, which comprises:

1. treating the material with a cationic polymeric pretreatment agent having a plurality of cationic centres and a degree of cationicity (expressed as cationic centres per units of molecular weight) of at least 1 cationic centre per 750 Daltons;

2. dyeing the material with a pre-metallized acid dye; and 3. optionally treating the material with a cationic polymer.

2. A method as claimed in claim 1 wherein the cellulosic fibrous material contains from 30 to 100% of natural, synthetic or regenerated cellulosic fibres or blends of such materials.

3. A method as claimed in claim 2 wherein the natural cellulosic fibrous material is cotton, flax, jute, hemp and/or ramie; and the synthetic or regenerated cellulosic fibrous material is rayon and/or a lyocell material.

4. A method as claimed in claim 1 wherein the fibrous material is a blend of one or more cellulosic fibres with non-cellulosic fibrous material.

5. A method as claimed in claim 4 wherein the fibrous non-cellulosic material is a polyethylene terephthalate polymer or related copolymer, and/or a wool, silk and/or synthetic polyamide fibre.

6. A method as claimed in claim 1 wherein the polymeric pretreatment agent contains poly-quaternary nitrogen centres which are of the formula $—N^+(R)_3$ where each R is an alkyl group; or where two of the groups R together with the nitrogen atom bearing them form a 5 or 6 membered heterocyclic ring; or $—N^+(R')_2—$ where the groups R' are as defined for R above and the other bonds directly or indirectly link into the polymer chain optionally via or 5- or 6-membered ring; and/or aromatic quaternary nitrogen centres.

7. A method as claimed in claim 1 wherein the polymeric pretreatment agent has a degree of cationicity (expressed as cationic centres per units of molecular weight) of from 1 cationic centre per 150 Daltons to 1 cationic centre per 500 Daltons.

8. A method as claimed in claim 1 wherein the pre-metallized acid dye is a 1:1 pre-metallized acid dyes, a 2:1 pre-metallized acid non-ionic solubilised dye, a 2:1 pre-metallized acid asymmetrical monosulphonated dye, or a 2:1 pre-metallized acid symmetrical di-sulphonated/dicarboxylated dye.

9. A method as claimed in claim 1 wherein the material is subjected to a post dyeing treatment with a cationic agent having a plurality of cationic centres.

10. A method as claimed in claim 1 wherein the dyed material is subjected to further deliberate washing or enzyme treatment.

11. A method as claimed in claim 1 wherein the cellulosic material is a cotton, rayon or lyocell material and the pre-metallized acid dye is a 2:1 pre-metallized acid asymmetrical monosulphonated dye.

* * * * *